United States Patent [19]

Janssen

[11] Patent Number: 4,934,828

[45] Date of Patent: Jun. 19, 1990

[54] APPARATUS FOR MIXING VISCOUS MATERIALS

[75] Inventor: Robert A. Janssen, Alpharetta, Ga.

[73] Assignee: CIBA-GEIGY Corporation, Ardsley, N.Y.

[21] Appl. No.: 362,696

[22] Filed: Jun. 7, 1989

[51] Int. Cl.[5] ..... B01F 7/18

[52] U.S. Cl. ..... 366/307; 366/327

[58] Field of Search ..... 366/279, 307, 244, 245, 366/247, 249, 250, 251, 325, 327, 330, 331; 422/135

[56] References Cited

U.S. PATENT DOCUMENTS

| | | | |
|---|---|---|---|
| 3,321,283 | 5/1967 | Ewald | 366/307 |
| 3,709,664 | 1/1973 | Krekeler | 366/307 |
| 4,798,131 | 1/1989 | Ohta | 366/307 |
| 4,805,154 | 2/1989 | Schneider | 366/307 |

*Primary Examiner*—Robert W. Jenkins

*Attorney, Agent, or Firm*—Vincent Creedon; Irving M. Fishman

[57] ABSTRACT

An apparatus for mixing viscous materials has a tank for holding a viscous liquid to be mixed with the upper surface of the liquid at a mixing level in the tank, an impeller rotatably mounted in the tank coaxial with the cylindrical axis of the tank with a plurality of flat lower impeller blades mounted thereon at equally spaced intervals therearound, and inclined to the vertical and at least one plurality of upper blades mounted thereon at equally spaced intervals therearound and substantially midway between the circumferential positions of the lower blades and inclined to the vertical in the same direction as the lower blades and at a greater angle, a drive motor driving the impeller shaft in a direction in which the upper edges of the blades are the leading edges in the direction of rotation, and a plurality of baffles in the tank body at intervals around the inside peripheral surface of the tank between the tank wall and the ends of the blades and having a flat surface on the front side and a surface facing on the back side with a cross-sectional shape of substantially half of an ellipse with the major axis extending circumferentially.

16 Claims, 2 Drawing Sheets

APPARATUS FOR MIXING VISCOUS MATERIALS

The present invention relates to an apparatus for mixing together into a solution materials which are or tend, upon mixing, to become viscous, and more particularly to an apparatus for mixing together a solid particulate powder into a solvent for dissolving it and then efficiently stirring the resulting solution which tends to become highly viscous, or mixing two or more viscous liquids, at least one of which is highly viscous.

BACKGROUND OF THE INVENTION

The forming of a solution of a material which is quite viscous by dissolving a solid particulate powder of the material in a solvent, and then efficiently stirring the resulting mixture until the power is dissolved, during which time the solution becomes highly viscous, has been rather difficult to accomplish. Many commercially available impellers for carrying out such stirring have been evaluated in a mixing vessel, and have failed because of one or more of the following reasons:

1. All of the flow of liquid from the impeller is radial, which generates discrete liquid flow zones in the vessel resulting in minimal intermixing in these zones.
2. Production of stagnant layers and zones in the liquid as a result of the particular design of the blades of the impeller.
3. Poor shear action of the impeller on the liquid, which results in ineffective dissolution of the particulate material in the solvent.
4. The action of the impeller in pumping the liquid around in the vessel is too low to effectively mix two liquid reactive components which produce a viscous solution in a time period within which the components react.
5. Too much swirling of the liquid by the impeller, with the subsequent production of vortexes and entrapment of gas in the solution.

In order to minimize the swirling of the viscous liquid being mixed, it has been proposed to provide in the mixing vessel baffles consisting of flat blades. When such baffles are evaluated, however, although the vortexing and swirling of the liquid is reduced, stagnant zones are formed directly on the back side of such baffles as a result of the highly viscous nature of the liquid and the resulting flow pattern.

OBJECT AND BRIEF SUMMARY OF THE INVENTION

It is an object of the present invention to provide an apparatus for both dissolving a solid particulate powder of a material such as a polymer in a solvent for the solid particulate, and then to efficiently stir the resulting solution, which becomes highly viscous, or for efficiently stirring two or more viscous liquids, at least one of which is highly viscous, to mix them together.

It is a further object to provide such an apparatus which avoids the disadvantages of the prior art, and is able to mix a solid particulate rapidly into the solvent to dissolve it, or to mix two or more viscous liquids, at least one of which is highly viscous, without generation of excessive swirling, vortexing and subsequent gas entrapment, as well as to generate adequate shear so as to dissolve the solids in the solvent in a controlled and desired manner or to efficiently stir the viscous liquids.

To this end, the invention of the present application is an apparatus for mixing together into a solution materials which are or tend, upon mixing, to become viscous, comprising a substantially cylindrical vertically oriented tank having an open top, and a lid removably mounted on the tank for closing the open top, the tank being adapted to hold a viscous liquid which is being mixed with the upper surface of the liquid at a mixing level in the tank. An impeller is rotatably mounted in the tank, which has a vertical shaft rotatably mounted coaxial with the cylindrical axis of the tank, a plurality of lower impeller blades mounted on the shaft at equally spaced intervals therearound, these lower blades being flat substantially rectangular blades inclined to the vertical and having the lower edges thereof spaced only slightly above the bottom of the tank, and a plurality of upper blades mounted on the shaft at equally spaced intervals therearound and substantially midway between the circumferential positions of the plurality of lower blades. The upper blades are similarly flat and substantially rectangular blades inclined to the vertical in the same direction as the lower blades, but at a greater angle, and having the lower edges spaced upwardly from the upper edges of the lower blades and the upper edges below the mixing level. The radially outer ends of the lower and upper blades are spaced from the inside peripheral surface of the tank a distance for defining a baffle receiving space. A driving means is connected to the impeller shaft for driving the impeller in rotation in a direction in which the upper edges of the blades are the leading edges in the direction of rotation and the lower edges are the trailing edges. A plurality of baffles is positioned in the tank at intervals spaced around the inside periphery in the baffle receiving space, and these baffles are vertically extending rod-like members with the upper ends above the mixing level and the lower ends spaced only slightly above the bottom of the tank. They have a flat surface on the side facing in the direction opposite to the direction of rotation of the impeller shaft and a surface which is substantially elliptical in horizontal cross section facing in the same direction as the direction of rotation of the impeller shaft. A baffle mounting means is connected between the baffles and the inside peripheral surface of the tank at a level above the mixing level for mounting the baffles on the tank. Preferably braces extend between the baffles for bracing the baffles against movement out of a vertical position.

With this apparatus, the impeller imparts axial rather than radial flow to the liquid. The axial flow generates an overall liquid flow pattern in the vessel which spans the entire vertical distance of the liquid with upward flow at the walls of the vessel and downward flow at the impeller shaft. By this apparatus, effective and efficient mixing of the solid particulate material, such as a polymer, into a solvent and then mixing of the resulting viscous liquid, or mixing of two or more viscous liquids, or a highly viscous liquid and a lower viscosity liquid, with each other, can be achieved.

BRIEF DESCRIPTION OF THE DRAWINGS

Other and further objects of the invention will become apparent from the following detailed description thereof, taken in conjunction with the accompanying drawings, in which.

DETAILED DESCRIPTION OF THE INVENTION

Figure 1:
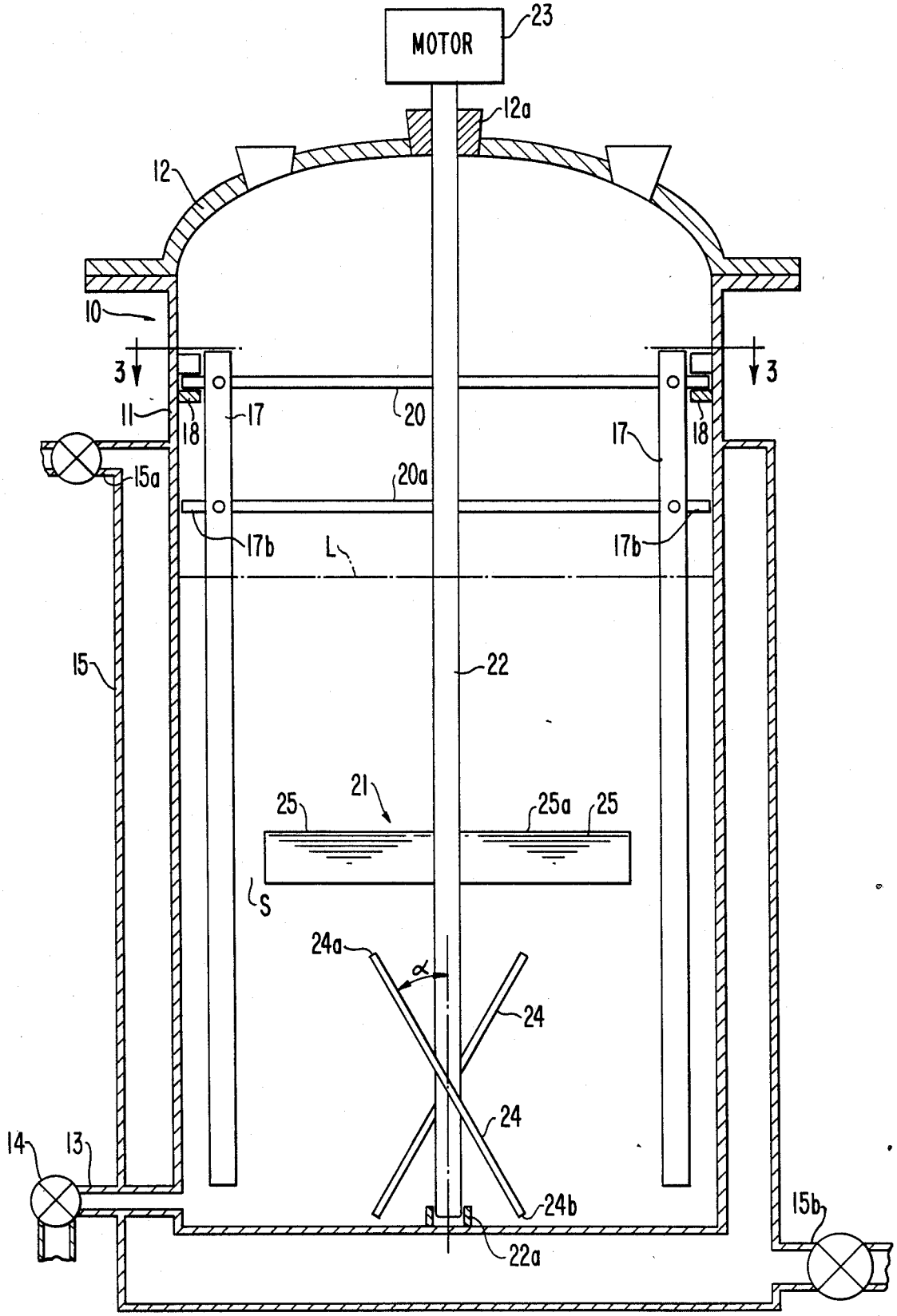
FIG. 1 is a sectional elevation view of a preferred embodiment of the mixing apparatus according to the present invention taken along section line 1—1 of FIG. 3.

In a preferred embodiment, the apparatus of the present invention comprises a tank 10, having a substantially right circular cylindrical vertically oriented tank body 11 with an open top, and a lid 12 removably mounted on the tank for closing the open top. The lid can be secured by any conventional closure means, such as clamps, bolts, or the like, which, since they are conventional, are not shown. The tank is adapted to hold a body of liquid, which can be a body of solvent into which particulate solid material, such as a polymer, is to be dissolved so as to produce a viscous liquid, or a body of viscous liquid which is composed of two or more liquids of different viscosities, at least one of which is highly viscous, to be mixed together. The tank is adapted to hold this body of liquid with the upper surface of the liquid at a mixing level L in the tank. By the term "substantially right circular cylinder" is meant a geometric shape which approximates that of a right circular cylinder, namely a shape having a transverse cross-section of hexagon, or a geometric figure with more sides than a hexagon.

The tank body 11 has a conventional drain 13 in the bottom thereof with a valve 14 for controlling the flow of liquid out of the tank.

Surrounding the tank is a conventional fluid jacket 15 having a valved outlet **15*a* at the upper end and a valved inlet 15*b* at the lower end, for conducting a fluid, such as water, through the jacket 15 for controlling the temperature within the tank body 11. For example, if it is desired to heat the liquid within the tank body, a hot fluid is passed through the jacket 15, whereas if cooling is desired, a cold fluid is passed through the jacket 15**.

Positioned within the tank 10 is an impeller generally indicated at 21, which is comprised of a vertical shaft 22 with the lower end supported on a bearing **22*a* on the bottom of the tank, and the upper end extending through a bearing 12*a* in the lid 12 out through the lid 12. While the bearing 22*a* in the bottom of the tank is shown as a simple solid thrust bearing, it can, by appropriate structural changes, be converted into a combined bearing and drainage valve, replacing the outlet 13 and valve 14**.

Figure 2:
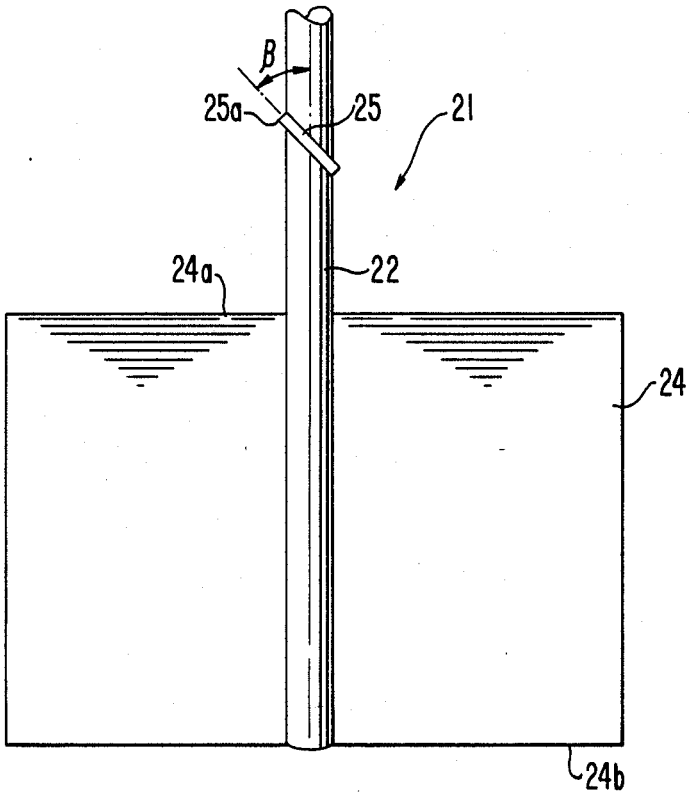
FIG. 2 is an elevation view of the blade carrying portion of the impeller of FIG. 1 taken from a direction at right angles to the direction of FIG. 1.

Mounted on the shaft 22 is a plurality of lower impeller blades 24 positioned at equally spaced intervals therearound. In the preferred embodiment the interval is 180°. The lower blades 24 are flat substantially rectangular blades, as shown in FIG. 2, and are inclined to the vertical by an angle $\alpha$ which can be from 25°–35°. The lower edges of the blades are spaced only slightly above the bottom of the tank with a spacing of ½ to 1 cm. The impeller further comprises at least one plurality of upper blades 25. In the preferred embodiment there is only one plurality of such blades. These blades are likewise mounted on the shaft 22 at equally spaced intervals therearound, and in the preferred embodiment there are two such blades mounted at intervals of 180°. Moreover, these blades are substantially midway between the circumferential positions of the lower blades 24. The upper blades 25 are also inclined to the vertical in the same direction as the lower blades 24 and at an angle $\beta$ which is greater than the angle $\alpha$, and which can be from 35°–45°. While in the preferred embodiment, the number of upper blades is shown as two, there can be any number up to six such blades. The upper blades 25 are approximately one-fifth the width of the lower blades 24 as measured transverse to the length of the face of the blades and parallel to the face, and the radial dimension of the upper blades is the same as the radial dimension of the lower blades.

In the preferred embodiment, the lower blades are connected to the shaft at a point slightly closer to the lower edge **24*b*** thereof than the mid-point of the width of the blade. The upper blades are connected to the shaft at a point midway along the width thereof, and this point is approximately three times farther above the bottom of the tank than the mounting point of the lower blades.

The radially outer ends of the lower and upper blades 24 and 25 terminate at a point spaced from the inside peripheral surface of the tank body 11 to leave a baffle receiving spaces therebetween.

The shaft 22 extends above the top of the lid 12, and there is connected thereto a drive means 23 for driving the impeller shaft in rotation. This drive means can be an electric motor with the output shaft thereof directly connected to the drive shaft 22, and means for controlling the speed of such a motor, or can be an electric motor indirectly connected through a transmission means to the shaft 23, with means for controlling the transmission ratio and/or the speed of the motor. This drive means is conventional, and forms no part of the present invention, and accordingly will not be described further.

The drive means drives the impeller shaft in a rotational direction in which the upper edges **24*a* and 25*a* of the blades 24 and 25 are the leading edges in the direction of rotation, and the lower edges 24*b* and 25*b*** are the trailing edges. The drive means drives the impeller sufficiently fast to provide an impeller Reynolds number $N_{Re}$ of 10 to 10,000, where $$N_{Re} = \frac{N\,Da^2\,p}{\mu}$$

in which Da is the impeller diameter, N is the rotational speed in rps, p is the liquid density and $\mu$ is the viscosity.

A plurality of baffles 17 is positioned in the tank body 10 at intervals spaced around the inside peripheral surface of the tank and in the baffle receiving space S. There can be from three to six such baffles. The number of baffles is related to the size of the tank, a smaller number of baffles being appropriate for a smaller tank and a larger number for a larger tank, and they are spaced inwardly of the inside peripheral surface of the tank approximately 1/20 of the diameter of the tank. Baffle support brackets 18 are mounted on the inside peripheral surface of the tank at a position above the mixing level L and consists of generally U-shaped elements for receiving bracket engaging supports 17 projecting radially outwardly from the baffles 17.

The baffles are vertically extending rod-like members having the upper ends above the mixing level L and the lower ends spaced only slightly above the bottom of the tank. They each have a flat front surface **17*c* on the side facing in the direction opposite to the direction of rotation of the impeller shaft 22, and a surface 17***d* on the back side of the baffle, i.e. the side facing in the same direction as the direction of rotation of the impeller shaft. The surface 17*d* has a shape which has a cross-section of substantially one-half of an ellipse with one-half the major axis e perpendicular to the front surface 17*c*. The length of the axis e is preferably 1/20 of the inside diameter of the tank. The width of the baffle face 17*c*, i.e. dimension in the radial direction of the tank, is approximately 1/20 of the diameter of the tank body 11.

The radially outermost ends of the blades 24 and 25 are spaced approximately 1/20 of the diameter of the tank body 10 from the innermost edge of the baffles.

In the preferred embodiment, the baffles are joined by a set of braces 20 extending generally in the direction of the circumference of the tank body 11, and joined to the respective surfaces of circumferentially adjacent baffles. In the preferred embodiment, the braces are curved outwardly to a curvature which is concentric with the curvature of the inside peripheral surface of the tank body, and are circular cross-sectional rods. However, the braces can be other than circular in cross section, and can, instead of being concentrically curved, be straight, or curved less than concentrically.

In the preferred embodiment, there is provided at least one further set of braces 20*a*, spaced downwardly from the braces 20, and corresponding in configuration to the braces 20. The lowermost of any such additional braces is positioned above the mixing level L. Further, the baffles 17 may have wall engaging supports 17*b* extending outwardly therefrom and engaging the inside peripheral surface of the tank. These wall engaging supports are preferably at the same level as the additional braces 20*a*. The braces 20 and 20*a* and the additional supports 17*b* brace the baffles 17 against movement out of the vertical position. However, if the baffles 17 are sufficiently rigid, the braces can be omitted.

Figure 3:
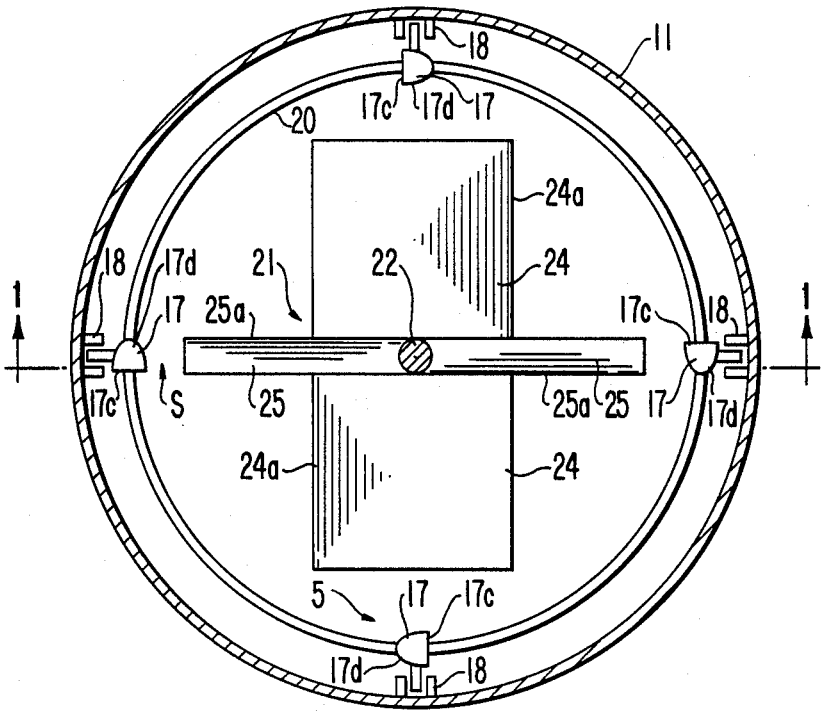
FIG. 3 is a sectional plan view taken on line 3—3 of FIG. 1.

In operation, for mixing a particulate material into a solvent and then stirring the resulting mixture during which time the solution becomes highly viscous, the tank 10 is first filled with a solvent to near the mixing level L, and then the particulate material is gradually added as the drive means 23 drives the shaft 22 for rotating the blades 24 and 25 in the direction as shown by the arrow in FIG. 3. The location of the lower edge 24*b* of the lower blades close to the bottom of the tank causes the blades to exert a high fluid pumping action on the solution so as to circulate it downwardly, circumferentially and outwardly, and thence upwardly along the inner surface of the wall of the tank body 11. A high shear effect is also produced. The upper blades 25 function to pump the liquid in the upward portion of the tank in a downward direction. These blades are provided because it was found during the experimental work leading to the present invention that the bottom blades 24 by themselves did not have sufficient capacity to pull the liquid in the tank downwardly to keep the upper third of the liquid in motion. The action of the upper blades 25 produces not only a downward action on particulate which may be floating on the liquid surface or in the vicinity of the liquid surface, but it also supplies liquid and particulate to the lower impeller blades so as to cause them to operate effectively. In addition, the upper blades produce a back pressure of the liquid coming from the upper portion of the tank against the back side of the lower blades 24, which prevents volatilization of any low boiling point liquids which may be present in the solution due to reduced pressure along the back of the lower blades caused by the rotation of the lower blades through the liquid. As a result, the combination of the rotational movement imparted to the fluid in the circumferential direction of the tank body 11 as well as the axial movement imparted thereto, the axial movement having an upward flow along the walls of the tank, and a downward flow near the impeller shaft, produces a fast efficient mixing of the particulate into the solvent, and keeps the viscous liquid both well mixed and circulating within the tank 11.

Experimental work with the apparatus has shown that the apparatus can produce correct fluid flow patterns and mixing action sufficient to handle a solution which has a viscosity of up to 5,000 CPS, and which contains a volatile component. It was found that operators were able to do a dissolution phase and chemical reactions with the same apparatus. There was minimal swirling in the liquid, and, in turn, no production of vortexes which cause unwanted "whipping" of gas bubbles into the solution.

Where two or more highly viscous liquids are to be mixed, or a liquid of low viscosity is to be mixed with a liquid of high viscosity, the one liquid is filled into the tank 11 to a depth according to the proportion of the one liquid in the overall mixture, and the remaining liquid is filled into the tank to bring the level of the mixture up to the mixing level L, as the impeller 21 is being rotated. The same liquid flow patterns and efficient mixing of liquids is produced in such a mixing operation, and the apparatus operates as efficiently as for the mixing of particulate material into a solvent.

BEST MODE

For mixing particulate polyvinyl alcohol (PVA) polymer into a solvent therefor, such as dimethylsulfoxide (DMSO), the apparatus as shown in the drawings had a tank body 11 with a height of 30 cm and an inside diameter of 19 cm. Two lower blades 24 were provided, and were mounted on the shaft 22 at an angle of 30° to the vertical, and attached at a point 4.8 cm above the lower end of the shaft. A space of approximately 1 cm was left between the lower edges 24*b* of the lower blades and the bottom of the tank. The blades 24 were 11 cm wide and the outside diameter of the two blades when attached to the shaft 22 was 13 cm.

The upper blades 25 were attached to the shaft 22 at a height of approximately 13 cm from the lower end of the shaft, and had a blade width of 2 cm, and were inclined to the vertical at an angle of 40°. They had the same diametrical dimension as the lower blades 24.

The baffles 17 were spaced from the inside peripheral surface of the tank body 11 a distance of 1 cm, and the width of the face 17*c* was approximately 1 cm, and the length of the one-half major axis of the ellipse was approximately 1 cm. The radially outer ends of the blades 24 and 25 were spaced approximately 1 cm from the inner edge of the baffles 17.

The bracket engaging supports 17*a* had the supporting surface approximately 30 cm above the bottom of the tank, and the baffles extended from approximately 1 cm above the bracket engaging supports to a point spaced approximately 1 cm from the bottom of the tank.

The shaft 22 was 0.375 inches in diameter, and the drive means was set to drive the shaft at a speed of from 200 to 300 rpms.

The apparatus was operated to dissolve approximately 600 grams of PVA polymer in a solvent of DMSO, in an amount of 5000 gm, to form a viscous solution of approximately 5,000 CPS, in approximately four hours at 60° C.

It will be seen that the apparatus according to the present invention is able to mix a solid particulate into a solvent to produce a highly viscous solution, or is able to mix two or more viscous liquids at least one of which is highly viscous, in a rapid and efficient manner without excessive swirling, vortexing and subsequent gas entrapment. Stagnant zones in the vicinity of the baffles are eliminated, so as to prevent accumulation of solid polymer against the wall of the tank or the baffle, and the liquid within the tank is circulated not only circumferentially, but also in a pattern upwardly along the wall of the tank and downwardly near the impeller for providing complete mixing of the materials throughout the body of liquids. The liquid is supplied to the back of the lower blades so as to maintain back pressure thereon so as to prevent volatilization of low boiling point liquids which may be present in the solution, and thus avoid generation of gas bubbles in the body of liquid. The blades carry out the mixing with minimal swirling, which substantially eliminates vortexing and the production of unwanted "whipping" of gas bubbles into the liquid.

What is claimed:

1. An apparatus for mixing viscous materials, comprising:

a substantially cylindrical vertically oriented tank body having an open top and a lid removably mounted on said tank for closing said open top, said tank body being adapted to hold a viscous liquid to be mixed with the upper surface of the liquid at a mixing level in said tank;

an impeller rotatably mounted in said tank and having a vertical shaft rotatably mounted coaxial with the cylindrical axis of said tank, a plurality of lower impeller blades mounted on said shaft at equally spaced intervals therearound, said lower blades being flat substantially rectangular blades inclined to the vertical and having the lower edges thereof spaced only slightly above the bottom of said tank, and at least one plurality of upper blades mounted on said shaft at equally spaced intervals therearound and substantially midway between the circumferential positions of said plurality of lower blades, said upper blades being flat substantially rectangular blades inclined to the vertical in the same direction as said lower blades and at a greater angle and having the lower edges spaced upwardly from the upper edges of said lower blades and the upper edges below said mixing level, the radially outer ends of said lower and upper blades being spaced from the inside peripheral surface of said tank body a distance for defining a baffle receiving space;

drive means connected to said impeller shaft for driving said impeller shaft in rotation in a direction in which the upper edges of said blades are the leading edges in the direction of rotation and the lower edges are the trailing edges;

a plurality of baffles positioned in said tank body at intervals spaced around the inside peripheral surface of said tank in said baffle receiving space, said baffles being vertically extending rod-like members having upper ends above said mixing level and lower ends spaced only slightly above the bottom of said tank, and further having a flat surface on the side facing in the opposite direction to the direction of rotation of said impeller shaft and a surface facing in the same direction as the direction of rotation of said impeller shaft which in horizontal cross section has the shape of substantially half of an ellipse with the major axis extending circumferentially; and baffle mounting means connected between said baffles and the inside peripheral surface of said tank at a level above said mixing level for mounting said baffles on said tank.

2. An apparatus as claimed in claim 1 further comprising braces extending between said baffles for bracing said baffles against movement out of a vertical position.

3. An apparatus as claimed in claim 1 in which the number of baffles is from three to six.

4. An apparatus as claimed in claim 1 in which the number of lower blades is two and said lower blades are spaced at 180° around said shaft.

5. An apparatus as claimed in claim 4 in which the angle of inclination of said lower blades is from 25°–35°.

6. An apparatus as claimed in claim 4 in which each of said lower blades is substantially one-half of a square.

7. An apparatus as claimed in claim 1 in which the number of upper blades in each plurality is from two to six.

8. An apparatus for mixing viscous materials, comprising:

a substantially cylindrical vertically oriented tank having an open top and a lid removably mounted on said tank for closing said open top, said tank being adapted to hold a viscous fluid to be mixed with the upper surface of the fluid at a mixing level in said tank;

an impeller rotatably mounted in said tank and having a vertical shaft rotatably mounted coaxial with the cylindrical axis of said tank, two substantially rectangular lower impeller blades mounted on said shaft spaced at 180 therearound, said lower blades being flat substantially rectangular blades inclined to the vertical at an angle of slightly above the bottom of said tank, and a plurality of from 25°–35° and having the lower edges thereof spaced only from two to six upper blades mounted on said shaft at equally spaced intervals therearound, said upper blades being flat substantially rectangular blades inclined to the vertical in the same direction as said lower blades and at a greater angle than the angle of inclination of said lower blades, said angle of inclination of said upper blades being from 35°–45°, and said upper blades having the lower edges spaced upwardly from the upper edges of said lower blades and the upper edges below said mixing level, the radially outer ends of said lower and upper blades being spaced from the inside peripheral surface of said tank a distance for defining a baffle receiving space;

drive means connected to said impeller shaft for driving said impeller shaft in rotation in a direction in which the upper edges of said blades are the leading edges in the direction of rotation and the lower edges are the trailing edges;

a plurality of from three to six baffles positioned in said tank at intervals spaced around the inside peripheral surface of said tank in said baffle receiving space, said baffles being vertically extending rod-like members having upper ends above said mixing level and lower ends spaced only slightly above the bottom of said tank, and further having a flat surface on the side facing in the opposite direction to the direction of rotation of said impeller shaft and which has a radial dimension about 1/20 the diameter of said tank, and further has a surface which is substantially elliptical in horizontal cross section facing in the same direction as the direction of rotation of said impeller shaft and with one-half the major axis of the ellipse about 1/20 the diameter of said tank;

said blades having the radially outer ends spaced from said baffles a distance about 1/20 the diameter of said tank;

baffle mounting means connected between said baffles and the inside peripheral surface of said tank at a level above said mixing level for mounting said baffles on said tank; and braces connected between said baffles for bracing said baffles against movement out of a vertical position.

9. An apparatus as claimed in claim 8 in which said braces are straight rods.

10. An apparatus as claimed in claim 8 in which said braces are curved rods curved outwardly toward the inside surface of said tank.

11. An apparatus as claimed in claim 9 or 10 in which there are a plurality of sets of braces spaced vertically in said tank.

12. An apparatus as claimed in claim 8 in which said lower blades are at an angle of 30°.

13. An apparatus as claimed in claim 8 in which said upper blades are at an angle of 40°.

14. An apparatus as claimed in claim 8 in which there are four baffles.

15. An apparatus as claimed in claim 8 in which said upper blades and said lower blades are mounted on said shaft at a mid-point of the width d, said blades and the position of the mounting point of said upper blades is about three times the distance of the mounting point of the lower blades from the bottom of the stirring shaft.

16. An apparatus as claimed in claim 8 in which the width of said upper blades is about one-fifth the width of said lower blades.

* * * * *